US006352459B1

(12) United States Patent
Hodge et al.

(10) Patent No.: US 6,352,459 B1
(45) Date of Patent: Mar. 5, 2002

(54) DEVICE FOR ANCHORING A UTILITY DEVICE TO A SPORTSBOARD

(76) Inventors: Jayne Hodge, 25346 Avanida Cappeil, Valencia, CA (US) 91355; Patricia Rielly, 27020 Rio Prado Dr., Valencia, CA (US) 91354

( * ) Notice: Subject to any disclaimer, the term of this patent is extended or adjusted under 35 U.S.C. 154(b) by 0 days.

(21) Appl. No.: 09/531,409

(22) Filed: Mar. 20, 2000

(51) Int. Cl.[7] ..... B65H 1/16

(52) U.S. Cl. ..... 441/68; 441/65; 441/74; 280/809

(58) Field of Search ..... 280/809; 441/65, 441/68, 70, 73, 74, 75, 136; 224/406, 436, 437, 438

(56) References Cited

U.S. PATENT DOCUMENTS 4,545,772 A * 10/1985 Stockhausen ..... 441/74
4,861,301 A * 8/1989 Pomeroy et al. ..... 441/131
4,955,835 A * 9/1990 Hollingsworth ..... 441/74
5,096,103 A * 3/1992 Baugh ..... 225/151
5,695,101 A 12/1997 Frietze
5,766,051 A 6/1998 Messer
5,845,994 A * 12/1998 Rice ..... 383/76
5,971,243 A * 12/1998 Peterson ..... 224/572
5,857,682 A * 1/1999 Hyman ..... 280/14.2
5,947,781 A 9/1999 Von Wald et al.
6,113,113 A * 9/2000 Longoni et al. ..... 280/14.2

* cited by examiner

*Primary Examiner*—J. J. Swann
*Assistant Examiner*—James S. McClellan
(74) *Attorney, Agent, or Firm*—Oppenheimer Wolff & Donnelly LLP

(57) ABSTRACT

A device for holding lubricating compounds on a sportsboard for use by a sportsperson includes a flexible support for receiving a reservoir for lubricant. The support can be anchored to the board, and the reservoir can be removed from the support as required. When removed, it can be used by the sportsperson. The support includes a flexible netting material which is anchored directly or indirectly to an aperture on a board such as a wakeboard.

5 Claims, 2 Drawing Sheets

DEVICE FOR ANCHORING A UTILITY DEVICE TO A SPORTSBOARD

BACKGROUND OF THE INVENTION

1. Field of the Invention

This invention relates in general to sportboards. In particular, it relates to wakeboards. More particular, it is concerned with a system for facilitating the use of wakeboards by sportspersons when they are in the water.

2. Description of Related Art

Different sportsboards are well known. These can be wakeboards, for use in water. Similarly, they can snowboards for use on snow. They can also be ski devices, surfboards and other boards used by the sportsperson.

A common problem with wakeboards in particular, is that the user periodically has to lubricate the board or needs different compounds or products for the person while they are in the water, or in the snow or on the field. In such positions, the user is far removed or inconveniently removed from a source for these lubricants. The source can be on the dock or in a boat. This inconvenience can create great frustration for the sportsperson.

Therefore, there is a need for providing mechanisms and systems to facilitate and promote convenience for the user of different compounds and lubricants for the sportsperson in those situations.

SUMMARY OF THE INVENTION

According to the present invention, there is provided a holder for compounds for use by a sportsperson using a sportsboard such as a wakeboard. There is provided a flexible material, such as a net with a mouth, for receiving the reservoir and permitting the removal of the reservoir from the flexible material. The reservoir can be for holding lubricants or soaps for use by the sportsperson on the person's body or on the board. An anchor secures the support to the sportsboard. The reservoir can be a plastic bottle, and the flexible material can be a net with a reinforced stiffer material or strap, and a plastic backing can be located between the strap and the sportsboard.

The foregoing and other objects, features, and advantages of the present invention will be apparent from the following detailed description of the preferred embodiments which makes reference to several drawing figures.

DETAILED DESCRIPTION OF THE PREFERRED EMBODIMENT

In the following description of the preferred embodiments reference is made to the accompanying drawings which form the part thereof, and in which are shown by way of illustration of specific embodiments in which the invention may be practiced. It is to be understood that other embodiments may be utilized and structural and functional changes may be made without departing from the scope of the present invention.

Wakeboarding is a relatively recent sport that combines the elements of surfing, skateboarding and snowboarding. Boards are approximately four feet in length and are constructed to provide a platform upon which a rider or floater stands. When pulled by a boat dragging a ski rope or the like, the wakeboarder uses the wake generated by the boat as a ramp or include upon which to perform tricks or stunts. Wakeboards are also used by skimming over the water behind the boat. As such, therefore, a wakeboarder grabs the line or handle of ski rope and is normally located in the water surface behind a boat. This creates a problem where the wakeboarder needs to lubricate the board with soap or other lubricants, or lubricate his own body or feet, which are placed in the wakeboard. The inconvenience is increased because it is often difficult for a boat to return to the wakeboarder conveniently to provide these lubricants.

Figure 1:
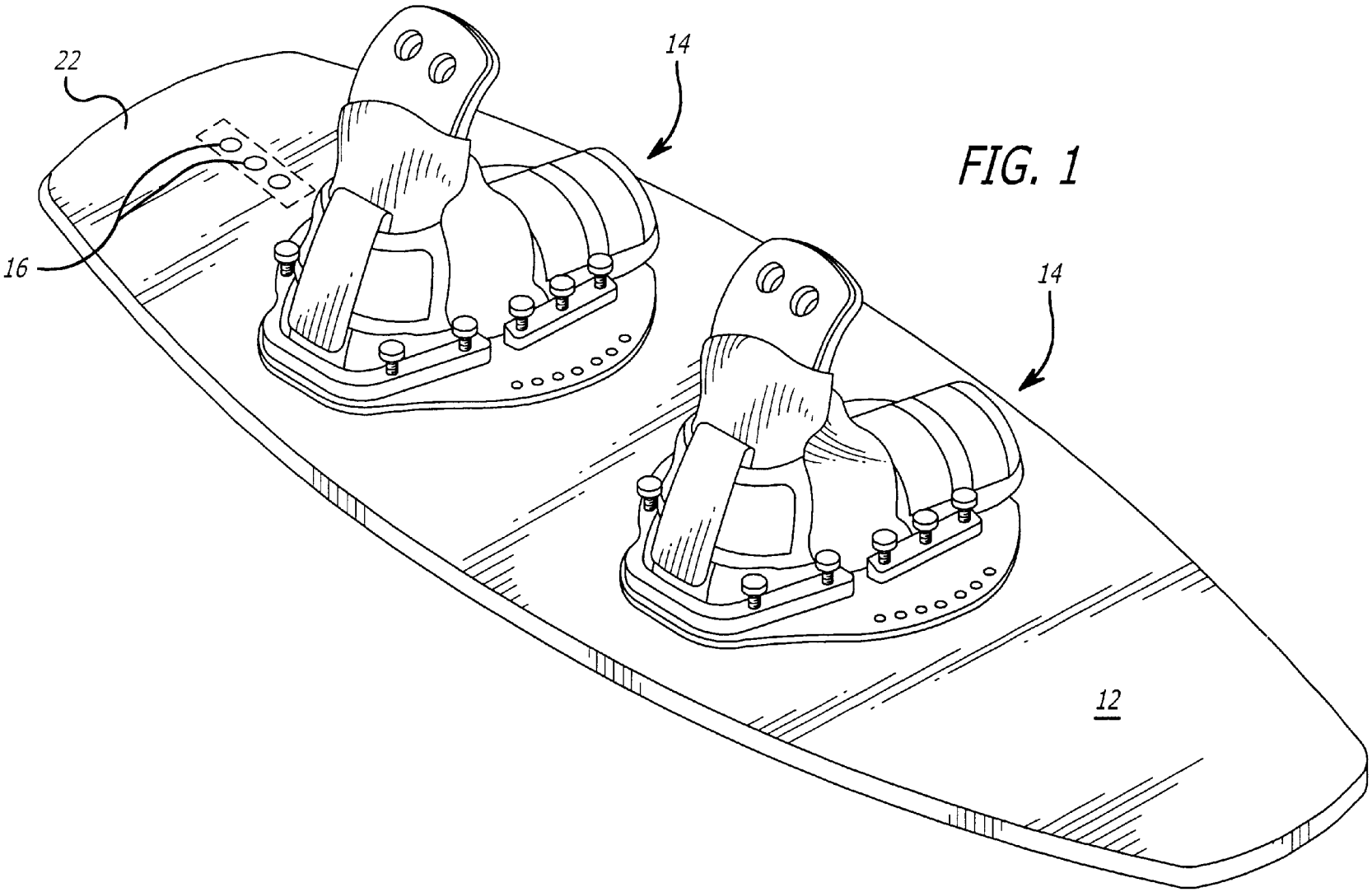
FIG. 1 is a perspective view of a wakeboard showing two socks in parallel relationship to each other, and the located for a holder for compounds on the wakeboard.
Figure 6:
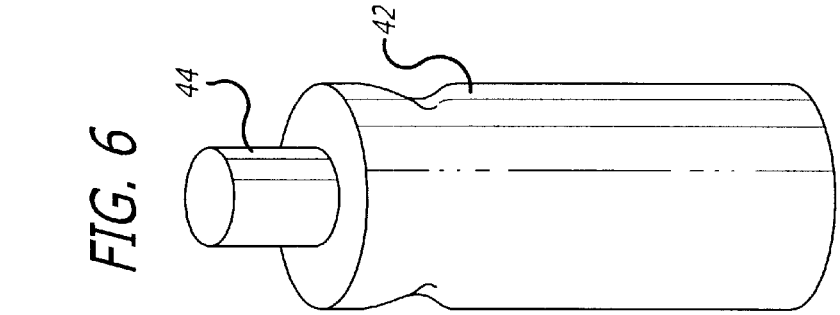
FIG. 6 is a side view of a plastic bottle reservoir for a lubricant such as soap.

In FIG. 1 there is shown a wakeboard 12 having a pair of bindings 14 secured to the top surface. As can be seen, the bindings can be anchored to the wakeboard in different techniques. For this purpose there are apertures directed through the wakeboard surface from the top end to the bottom end, for instance as is shown by apertures 16 to one side of the bindings or boots 14. There can be a series of apertures directed along the surface of the wakeboard so that the bindings or boots 14 can be located in different positions as to designed by a user. The apertures can extend through the wakeboard or partly into the wakeboard as required.

It is important for effective use of the wakeboard and the user of the wakeboard that there be effective lubrication of the board or the feet of the user in the wakeboard.

Figure 4:
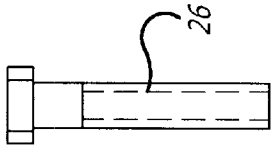
FIG. 4 is a side view of a bolt.
Figure 2:
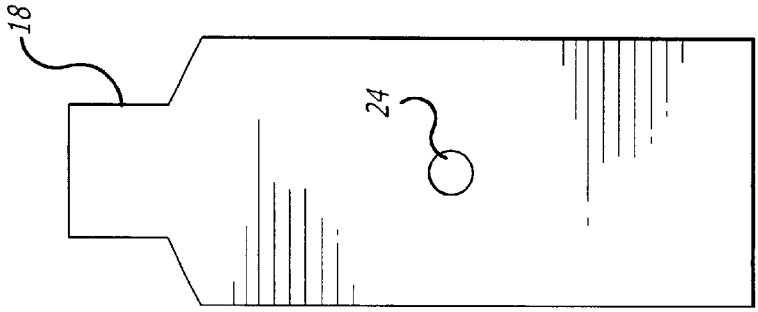
FIG. 2 is a top plan view of a plastic reinforcing backing.

In FIG. 2 there is shown a plastic backing material 18 which acts as the interface between a support of flexible net material 20 and the surface 22 of the wakeboard. The plastic backing material has an aperture 24 for receiving a bolt 26, which is shown in FIG. 4. Between the plastic backing 24 and the netted material 20 and on the surface 22 there is a washer 28. There is an aperture 30 through the washer 28 for receiving the bolt 26.

Figure 5:
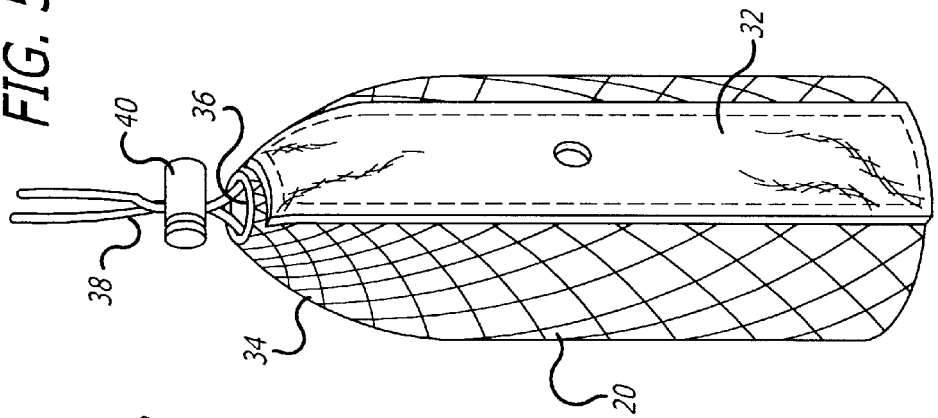
FIG. 5 is an under view of a plastic netting for the support showing the reinforcing nylon strap at the base of the netting and sharing a drawstring at the mouth of the device.
Figure 3:
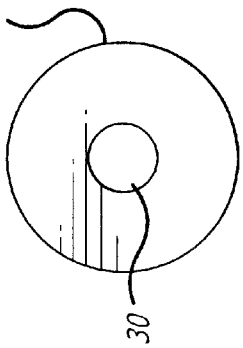
FIG. 3 is a plan view of a washer.

As shown in FIG. 5 there is a net flexible material 20 which can be made of any kind of plastic constituent, which is suitable for use in the environment such as water, snow or the like. Behind that flexible material, there is a nylon strapping material 32 which is affixed by stitching adhesive or the like to the base of the material 20. This provides for some rigidity to the flexible material when it is mounted on the surface 22 of the wakeboard 12. The neck on one end portion 34 of the flexible material 20 ends in a mouth 36 around which there is a drawstring 38. There is a cordstop with string strap 40 which is mounted on the strings 38 so that the mouth 36 can be opened and closed as required. A reservoir 42 is provided, which in the form of a plastic bottle for holding lubricating fluids or soap.

The bottle 42 has a conventional screw cap 44 or can be a flip opening to permit the contents of the bottle 42 to be removed.

In use, the net material 20 through strap 32 is bolted onto the surface 22 of the wakeboard 12. The bolt 26 passes through the apertures 16 in the wakeboard. Interfaced between the net 20 and strap 32 there is located the plastic backing 18, which is located adjacent the nylon straps or reinforcing material 32.

The bottle 42 is located in the net holder with the mouth 36 drawn closed through the strings 38.

When a user is in the water and wishes to remove the container 42, the drawstring 38 is opened by moving the cordstop 40 towards the end of the cordstop so that the mouth 36 can be opened and the container 42 removed. After use, the reservoir 42 is replaced in the holder 20, and the cordstop is tightened and the mouth 36 closed. In this manner, an effective ability is provided for using the lubricant for instance, on the foot, when the wakeboard and the wakeboarder are in the water.

Although the invention has been defined with regard to wakeboards, there can be other boards which can use this facility.

An essence of the invention is the ability to affix a holder device to a wakeboard or other sportsboard, which can be a snowboard, surfboard or the like, so that the user can use compounds to facilitate the sporting activity.

Although the device for holding the reservoir is described as having a flexible material with a mouth, this can be defined in different kinds of ways. There can be other slide on or slip on mechanisms for receiving the reservoir 42. In other situations therefore, the reservoir 42 can be formed with a suitable groove to receive a rail on the mounting or support.

Since the wakeboard will undergo multiple different forces while in the water or being used for sport, it is however desirable that the mechanism support and mounting permit for effective securing of the reservoir through different kinds of motions. Accordingly, it is therefore desirable that the mounting or support be of a nature which secures the reservoir against forces in different directions. The embracing net device is highly desirable for that purpose. Also, by anchoring the net device with a single anchor bolt, the device can pivot about that bolt in a manner to provide least resistance. Where the wakeboard is intended to move in a transverse direction in the water, the device can be arranged so that the reservoir is orientated to provide the least resistance in that direction. Similarly, when the wakeboard is intended to move in a longitudinal direction the reservoir can be mounted to be present the least resistance in that direction, preferably longitudinally orientated in that direction.

In other forms of the invention, instead of a net material, other suitable materials preferably, flexible can be used to embrace the removable reservoir from the board. Also, different anchoring mechanisms can be used.

The foregoing description of the preferred embodiments of the invention has been presented for the purposes of illustration and description. It is not intended to be exhaustive or to limit the invention to the precise form disclosed.

Many modifications and variations are possible in light of the above teaching. It is intended that the scope of the invention be limited not by this detailed description, but rather by the claims appended hereto.

What is claimed is:

1. A wakeboard comprising: a support having a flexible material for receiving a reservoir and permitting the removal of the reservoir from the support, wherein the support includes a mouth for receiving the reservoir which is removable from the mouth of the support, and wherein the flexible material is a net material with the mouth being closable and openable by a drawstring formed about the mouth, the drawstring having a string stop, the string stop permitting the drawstring to be positioned on the drawstring in different positions to thereby secure the mouth in an open position or closed position, and the flexible material includes an area of greater rigidity at a base of the flexible material; the area of greater rigidity being positioned adjacent to the wakeboard; a backing material affixed to said flexible material and positioned between said wakeboard and said flexible material, wherein the backing material is positioned between the area of greater rigidity and the wakeboard; an anchor for securing the support to the wakeboard, wherein the anchor includes a bolt, and the wakeboard includes an aperture for receiving the bolt, the bolt extending into the aperture to thereby secure the device to the wakeboard; and a reservoir for a compound for use by a sportsperson either for use on the body of the of the sportsperson or on the wakeboard.

2. A wakeboard as claimed in claim 1, wherein the reservoir is a plastic container for receiving said compound, the compound being a lubricant.

3. A wakeboard as claimed in claim 1, wherein the backing material has a shape which is substantially similar to a shape of the reservoir.

4. A wakeboard comprising:

a reservoir for holding a compound for use either on a body of a person or on the wakeboard;

a holder affixed to said wakeboard, the holder including a support having a flexible material, the flexible material including an area of greater rigidity formed at a base of said flexible material, wherein the flexible material is a net material with the mouth being closable and openable by a drawstring formed about the mouth, the drawstring having a string stop permitting the drawstring to be positioned in different positions to thereby secure the mouth in an open position or closed position, and wherein the support includes a mouth for receiving said reservoir and permitting the removal of said reservoir from the support;

a backing material affixed to said flexible material and positioned between said wakeboard and said flexible material, wherein the backing material has a shape that is substantially similar to a shape of said reservoir; and an anchor for securing the holder to the wakeboard, wherein the anchor includes a bolt, and wherein the wakeboard includes an aperture for receiving the bolt, the bolt being capable of extending into the aperture to secure the holder to the wakeboard.

5. The wakeboard of claim 4, wherein the reservoir is a plastic container for receiving said compound, the compound being a lubricant.

* * * * *